US006866119B2

(12) United States Patent
Zheng

(10) Patent No.: US 6,866,119 B2
(45) Date of Patent: Mar. 15, 2005

(54) LADDER WITH SIDE SUPPORT ENHANCEMENT

(76) Inventor: Edward Zheng, 1736 Wright Ave., La Verne, CA (US) 91750

( * ) Notice: Subject to any disclaimer, the term of this patent is extended or adjusted under 35 U.S.C. 154(b) by 0 days.

(21) Appl. No.: 10/361,424

(22) Filed: Feb. 11, 2003

(65) Prior Publication Data

US 2004/0154867 A1 Aug. 12, 2004

(51) Int. Cl.[7] ..... E06C 1/00
(52) U.S. Cl. ..... 182/172; 182/159
(58) Field of Search ..... 182/160, 172, 182/107, 108, 152, 159, 156

(56) References Cited

U.S. PATENT DOCUMENTS 400,778 A * 4/1889 Lowe ..... 182/160
1,054,108 A * 2/1913 Garraway ..... 182/160
3,978,944 A * 9/1976 Hickman et al. ..... 182/162
4,011,926 A * 3/1977 Larson et al. ..... 182/107
4,569,419 A * 2/1986 Stoltz ..... 182/160

* cited by examiner

*Primary Examiner*—Alvin Chin-Shue
(74) *Attorney, Agent, or Firm*—Raymond Y. Chan; David and Raymond

(57) ABSTRACT

A ladder includes a standing frame comprising two parallel standing side legs, a plurality of step platforms transversely extended between the standing side legs of the standing frame, and a side support enhancement including two side ground supports each having a ground end and a pivot end pivotally connected to the respective standing side leg, two reinforcing arms pivotally connected to the side ground supports respectively; and two sliding joints for slidably connecting the reinforcing arms with bottom ends of the standing side legs respectively. Therefore, the reinforcing arms are slid inwardly to pivotally pull the side ground supports to align with the standing side legs respectively to form a compact unit and are slid outwardly to pivotally push the side ground supports away from the standing side legs respectively so that the side ground supports are inclindedly and outwardly extended from the standing side legs respectively.

6 Claims, 8 Drawing Sheets

LADDER WITH SIDE SUPPORT ENHANCEMENT

BACKGROUND OF THE PRESENT INVENTION

1. Field of Invention

The present invention relates to a ladder, and more particularly to a ladder with a side support enhancement, wherein the side support enhancement is adapted to enhance the ground support of the ladder to further stabilize the ladder when it is set up.

2. Description of Related Arts

Ladders are considered as one of the most convenient and easy accesses to overhead working platform which frequently required for fixing and installing overhead equipments. A conventional ladder comprises a standing frame having two parallel side legs, a supporting frame pivotally connected with an upper end of the standing frame, and a plurality of step platforms transversely and spacedly between the side legs of the standing frame.

Accordingly, the conventional ladder can be folded to a storage position by pivotally the standing frame towards the supporting frame and folded to a set up position that the front and supporting frames are pivotally folded to form an inverted V-structure such that the lower ends of the front and supporting frames are supported on the ground. However, the conventional ladder has several drawbacks.

For safety purpose, the ladder must be stably supported on the ground at the set up position. There are two main safety factors for maintaining the ladder in a stabilized manner, which are a folding angle between the first and second supporting frames and a distance between the two side legs of the standing frame. While increasing the folding angle, the distance between the lower ends of the front and second supporting frames is substantially increased. However, the height of the ladder will be reduced so as to reduce the overhead working ability of the ladder. In addition, when the distance between the side legs of the standing frame is increased, the size of the ladder must be structurally increased, so as to reduce the portability of the ladder even though it is folded up.

Another drawback of the conventional ladder is that the pivotal folding structure of the ladder is still resulted in a bulky size such that the conventional ladder is inconvenient and difficult to store and carry. Due to the demand of the ladder, a compact ladder has been required and chased by consumers.

By a simple analysis of the conventional ladder, as described above, one may easily discover that if the step platforms would be folded to receive into the two side legs of the standing frame, the size of the ladder would be substantially reduced. However, from engineering's viewpoint, folding the step platforms to the standing frame while keeping its stability and supporting ability unaffected is somewhat complicated and baffling.

First and foremost, if the step platforms are foldably connected between the side legs of the standing frame, their strength and stability of load carrying are difficult to ensure. Therefore, some sorts of highly reliable reinforcements have to be equipped to supplement the strength and stability lost and this is not successful for granted. If handle carelessly, the ladder will not be rigid enough and may cause harmful to the user.

Besides, in order to fold up the step platforms, each of them should be pivotally connected between the side legs of the standing frame. In addition, when the ladder is in the set up position, the step surface of each step platform must horizontally face upward so that the user is able to climb up the ladder through the step platforms. However, the typical joints only allow the step platforms to pivotally move toward the side legs. In other words, when the ladder is in the set up position that the standing frame is inclinedly supported on the ground, the step surface of each step platform is in a slanted position with respect to the ground. It is dangerous for the user to step on the slanted step surfaces of the step platforms for overhead working.

SUMMARY OF THE PRESENT INVENTION

A main object of the present invention is to provide a ladder with a side support enhancement which is adapted to enhance the ground support of the ladder to further stabilize the ladder when it is set up.

Another object of the present invention is to provide a ladder with a side support enhancement which comprises two side ground supports outwardly and inclinedly extended from a supporting frame of the ladder for increasing a safety base width of the ladder, thereby aiding to increase safety.

Another object of the present invention is to provide a ladder with a side support enhancement, which enables the supporting frame to be rigidly supported on the ground without altering or complicating the supporting frame structure.

Another object of the present invention is to provide a ladder with a side support enhancement, wherein the weight of the user applied on the step platform can further ensure the construction of the side support enhancement of the ladder.

Another object of the present invention is to provide a ladder with a side support enhancement, wherein the side ground supports are capable of folding towards to the supporting frame so that the ladder can be folded into a compact unit for easy and convenient carriage and storage.

Another object of the present invention is to provide a ladder with a side support enhancement, wherein the side ground supports are simultaneously folded outwardly when the ladder is folded into its set up position. In other words, the user is able to fold and unfold the side support enhancement in one single motion with respect to the folding operation of the ladder.

Another object of the present invention is to provide a ladder with a side support enhancement, which does not require altering the original structural design of the ladder, so as to minimize the manufacturing cost of the ladder incorporating with the side support enhancement.

Accordingly, in order to accomplish the above objects, the present invention provides a ladder, comprising:

a standing frame comprising two parallel standing side legs;

a plurality of step platforms transversely extended between the standing side legs of the standing frame; and a side support enhancement, comprising:

two side ground supports each having a ground end and a pivot end pivotally connected to the respective standing side leg of the standing frame;

two reinforcing arms pivotally connected to the side ground supports respectively; and means for slidably connecting the reinforcing arms with bottom ends of the standing side legs of the standing frame respectively, wherein the reinforcing arms are arranged to drive the side ground supports between a folded position and an unfolded position, wherein at the folded position, the reinforcing arms are slid inwardly to pivotally pull the side ground supports to align with the standing side legs respectively, and at the unfolded position, the reinforcing arms are slid outwardly to pivotally push the side ground supports away from the standing side legs respectively so that the side ground supports are inclindedly and outwardly extended from the standing side legs respectively to increase a safety distance between the ground ends of the side ground supports.

These and other objectives, features, and advantages of the present invention will become apparent from the following detailed description, the accompanying drawings, and the appended claims.

DETAILED DESCRIPTION OF THE PREFERRED EMBODIMENT

Figure 1:
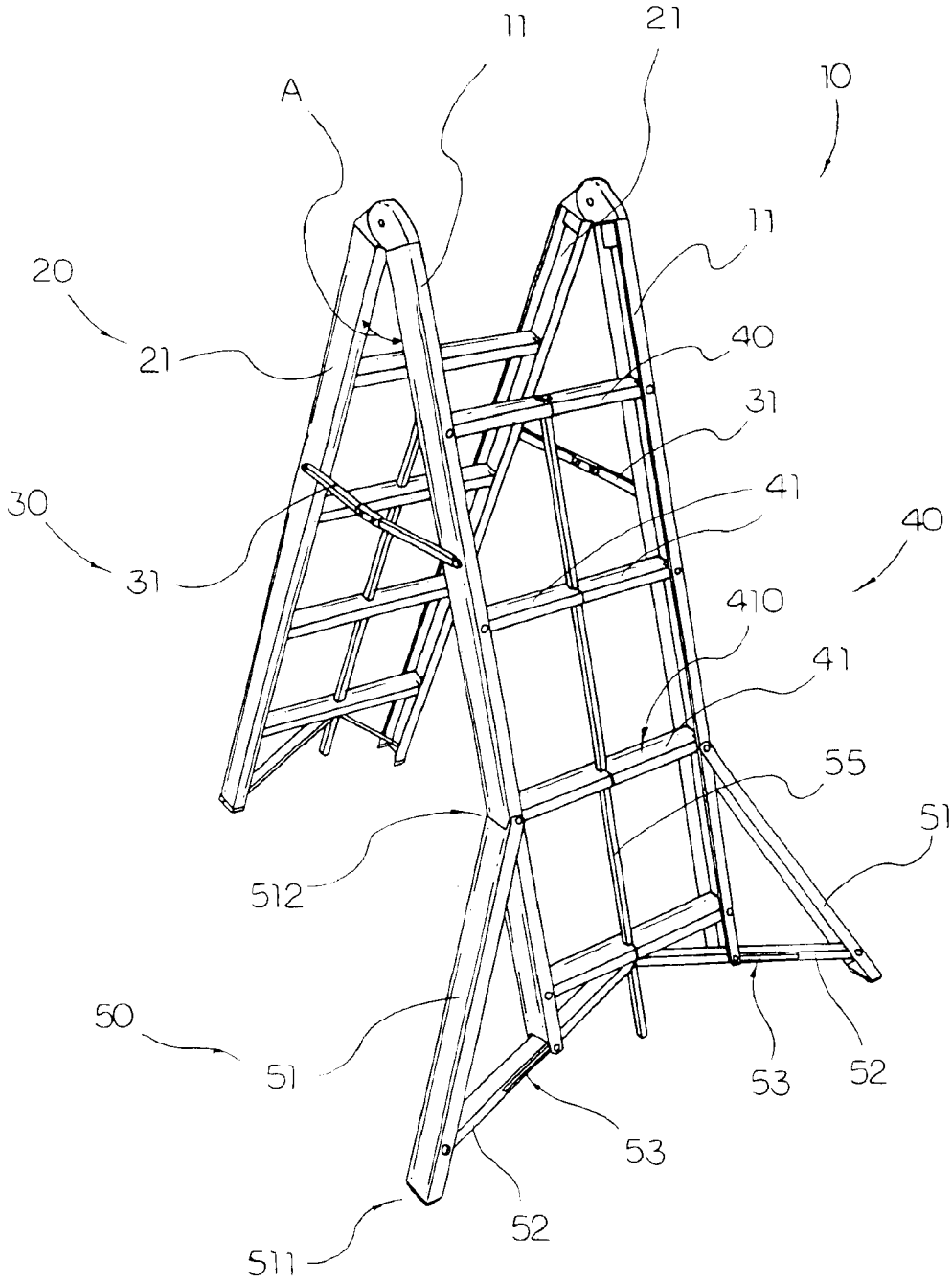
FIG. 1 is a perspective view of a ladder with a side support enhancement according to a preferred embodiment of the present invention.

Referring to FIG. 1 of the drawings, a ladder according to a preferred embodiment of the present invention is illustrated, wherein ladder, such as a conventional ladder, comprises a standing frame 10 comprising two parallel standing side legs 11, and a plurality of step platforms 40 transversely extended between the side legs 11 of the standing frame 10.

Accordingly, the ladder of the present invention can be a foldable ladder which further comprises a supporting frame 20 pivotally connected to an upper end of the standing frame 10, wherein the standing frame 10 is capable of being unfolded to a set-up structure that the standing frame 10 is pivotally folded apart from the supporting frame 20 and folded up to an overlapped structure that the standing frame 10 is pivotally folded towards the supporting frame 20 to define a folding angle A between the standing frame 10 and supporting frame 20.

Figure 2:
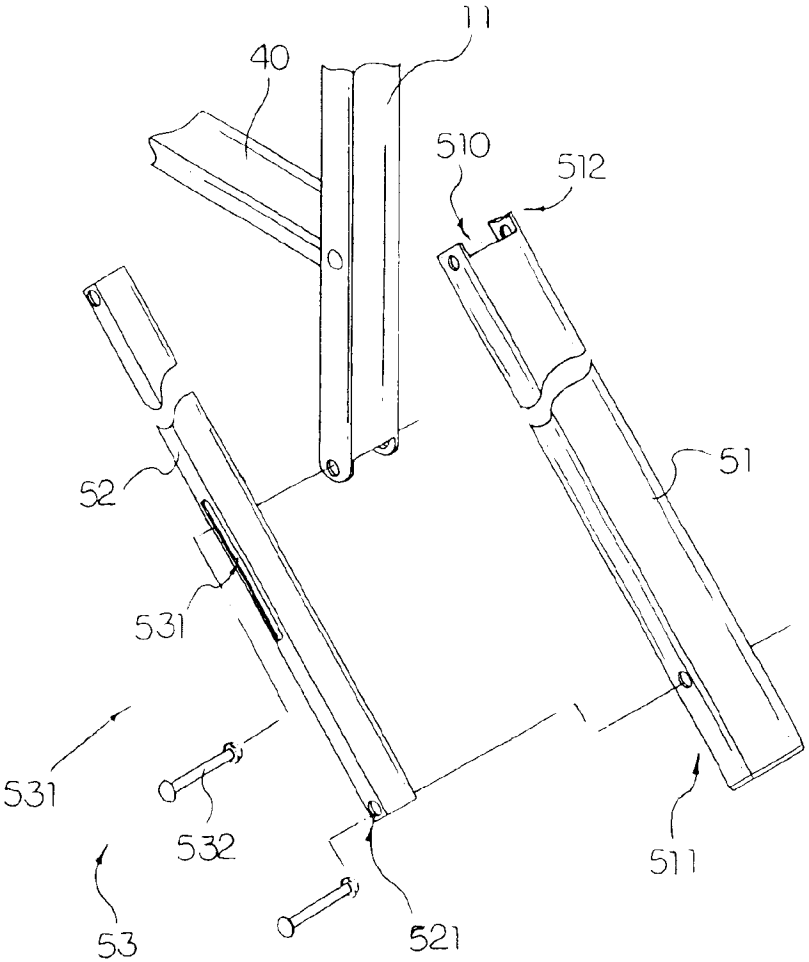
FIG. 2 is an exploded perspective view of the side support enhancement of the ladder according to the above preferred embodiment of the present invention.

As shown in FIG. 2, the ladder further comprises a side support enhancement 50 comprising two side ground supports 51 each having a ground end 511 and a pivot end 512 pivotally connected to the respective standing side leg 11 of the standing frame 10, and two reinforcing arms 52, and means 53 for slidably connecting the reinforcing arms 52 with bottom ends of the standing side legs 11 of the standing frame 10.

Figure 3A:
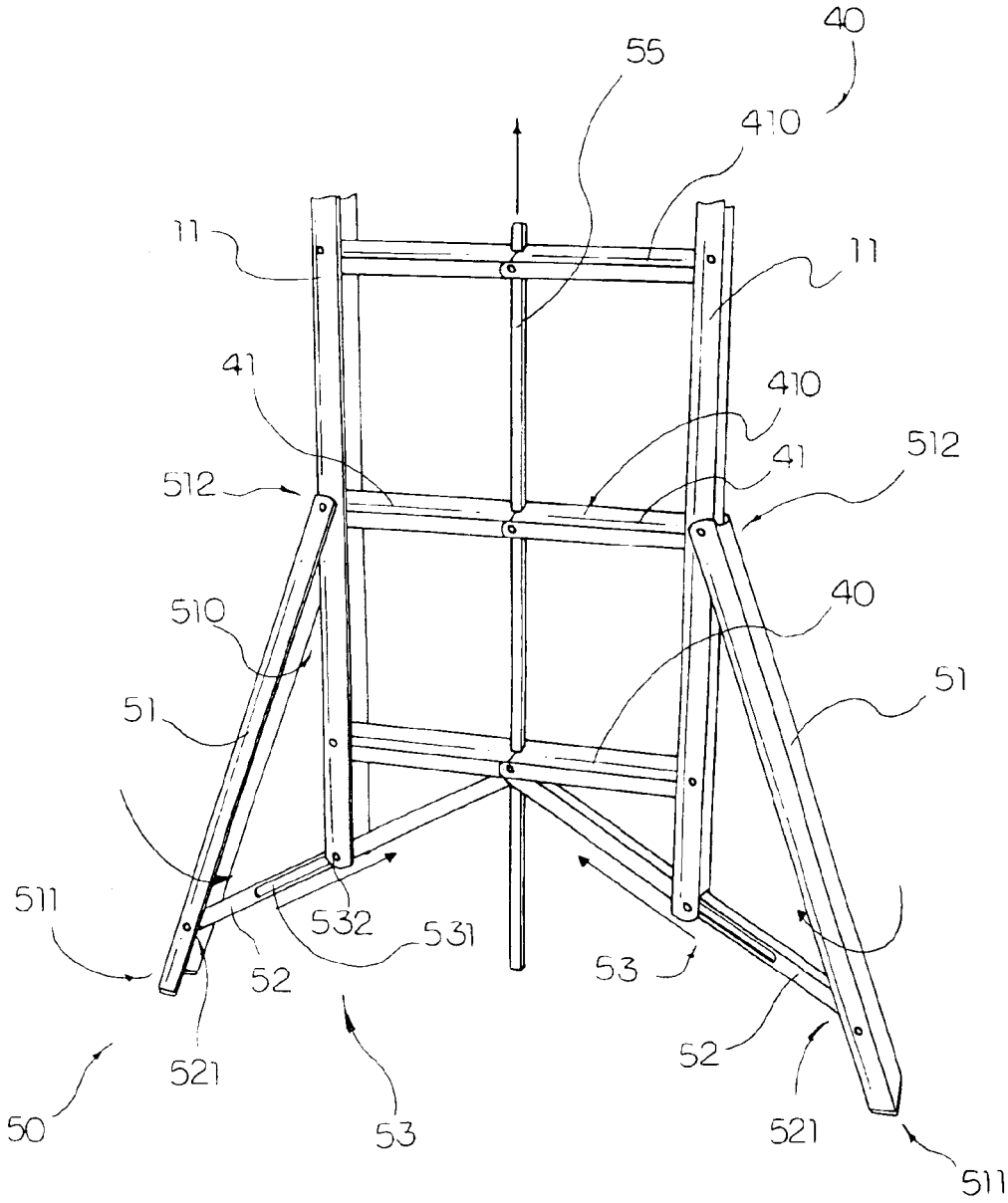
FIG. 3A is a partially perspective view of the ladder according to the above preferred embodiment of the present invention, illustrating the side support enhancement in an unfolded position.
Figure 3B:
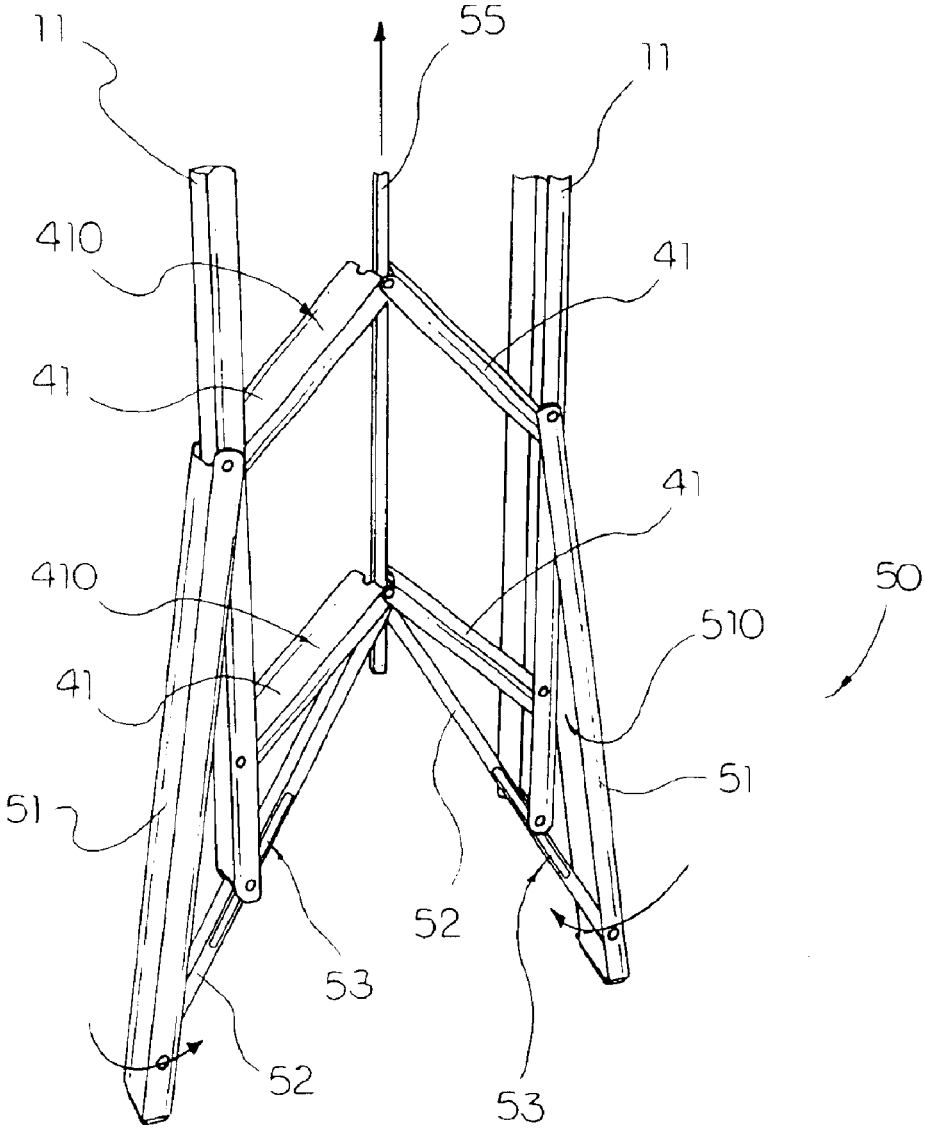
FIG. 3B is a partially perspective view of the ladder according to the above preferred embodiment of the present invention, illustrating the side support enhancement in a folded position.

Accordingly, the reinforcing arms 52 are arranged to drive the side ground supports 51 between a folded position and an unfolded position. In which, at the folded position as shown in FIG. 3A, the reinforcing arms 52 are slid inwardly to pivotally pull the side ground supports 51 to align with the standing side legs 11 respectively, and at the unfolded position as shown in FIG. 3B, the reinforcing arms 52 are slid outwardly to pivotally push the side ground supports 51 away from the standing side legs 11 respectively so that the side ground supports 51 are inclindedly and outwardly extended from the standing side legs 11 respective to increase a safety distance between the ground ends 511 of the side ground supports 51.

Accordingly, the safety distance of the conventional ladder as mentioned in background is the distance between two bottom ends of the side legs, i.e. the width of the conventional ladder. Therefore, the safety distance of the ladder of the present invention can be substantially increased by the inclination of the side ground supports 51, wherein the safety distance between the ground ends 511 of the side ground supports 51 is wider than the safety distance of the conventional ladder without altering the original structure of the conventional ladder.

According to the preferred embodiment, the supporting frame 20 comprises two parallel supporting side legs 21 each having an upper end pivotally connected to an upper end of the respective standing side leg 111 in such a manner that the standing frame 10 and supporting frame 20 are capable of pivotally folding to form a inverted V-structure at the folding angle A.

The ladder further comprises means 30 for retaining the standing frame 10 and supporting frame 20 at the folding angle A. wherein the retaining means 30 comprises a folding arm 31 having two ends pivotally connected to the first and second supporting frames 10, 20 respectively to retain the folding angle A therebetween.

As shown in FIG. 2, the pivot end 512 of each of the side ground supports 51 is pivotally connected to the respective standing side leg 11 between the upper and bottom ends thereof, wherein the ground end 511 of each of the side ground supports 51 is downwardly extended below the bottom end of the respective standing side leg 11 in such a manner that when the side ground supports 51 are sidewardly folded apart from the standing side legs 11 respectively, the bottom ends of the standing side legs 11 are rigidly supported on the reinforcing arms 52 respectively.

It is worth to mention that in order to slide the side ground supports 51 outwardly at the unfolded position, the downward force must be applied on the standing frame 10. Therefore, while using the ladder of the present invention, the downward force of the user's weight is applied on the standing frame 10 so as to ensure the side ground supports 51 at the unfolded position.

Accordingly, each of the side ground supports 51 has a U-shaped cross section defining a receiving cavity 510 for receiving a lower portion of the respective standing side leg 11 therein when the side ground supports 51 are folded towards the standing side legs 11 respectively. In other words, the lower portions of the standing side legs 11 are received in the receiving cavities 510 of the side ground supports 51 respectively at the folded position to form a compact unit for storage.

Each of the reinforcing arms 52 has a lower end 521 pivotally connected to the respective side ground support 51 between the ground end 511 and the pivot end 512 thereof, in such a manner that when the reinforcing arms 52 are slid sidewardly and outwardly with respect to the standing side legs 11, the lower ends 521 of the reinforcing arms 52 push the side ground supports 51 folding outwardly.

The connecting means 53 comprises two sliding joints 530 mounted at the bottom ends of the standing side legs 11 respectively to slidably connect the reinforcing arms 52 to the standing side legs 11 of the standing frame 10. Each of the sliding joints 530 has an elongated sliding slot 531 formed along the respective reinforcing arm 52 and comprises a slider axle 532 which is provided at the bottom end of the respective standing side leg 11 and slidably passed through the corresponding sliding slot 531 such that the reinforcing arms 52 are slidably connected to the bottom ends of the standing side legs 11 of the standing frame 10 respectively.

Accordingly, each of the sliding slots 531, having a predetermined length, has a folding end and an opposed blocking end, wherein when the slider axle 532 is slid to the folding end of the sliding slot 531, the side ground support 51 is pulled to folded towards the respective standing side leg 11, and when the slider axle 532 is slid to the blocking end of the sliding slot 531, the side ground support 51 is pushed to fold outwardly from the respective standing side leg 11. In other words, the slider axle 532 is stopped at the blocking end of the sliding slot 531 to retain the side ground support 51 at the unfolded position.

Figure 4:
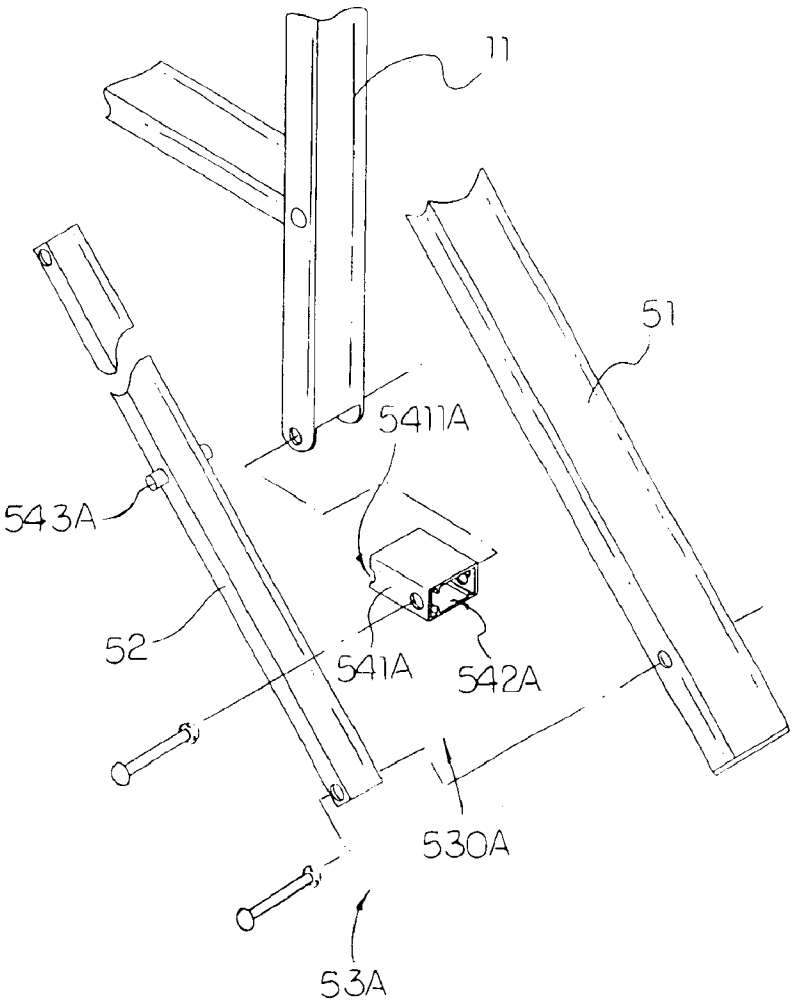
FIG. 4 illustrates an alternative mode of the sliding joint of the ladder according to the above preferred embodiment of the present invention.

FIG. 4 illustrates an alternative mode of the sliding joint 530A of the connecting means 53A which comprises a blocking stopper 541A mounted at the bottom end of each of the standing side legs 11 to form a slider slot 542A between the blocking stopper 541A and the respective standing side leg 11 for the respective reinforcing arm 52 sliding through, and a locker member 543A mounted at each of the reinforcing arms 52 and arranged in such a manner that when the reinforcing arm 52 is slid outwardly to push the side ground support 51 to the unfolded position, the locker member 543A is engaged with the blocking stopper 541A so as to stop a further sliding movement of the reinforcing arm 52. In other words, the sliding movement of the standing side leg 11 is stopped at the unfolded position when the locker member 543A is blocked by the blocking stopper 541A.

In addition, each of the blocking stoppers 541A has a locking groove 5411A facing the respective locker member 543A and arranged in such a manner that when each of the side ground supports 51 is slid to the unfolded position, the locker member 543A on the reinforcing arm 52 is slid to the respective locking groove 5411A so as to securely engage the locker member 543A with the blocking stopper 541A.

As shown in FIG. 3A, the side support enhancement 50 further comprises a control member 55 pivotally connected to upper ends of the reinforcing arms 52 for driving the side ground supports 51 between the folded position and the unfolded position. According to the preferred embodiment, when the control member 55 is moved downwardly, the reinforcing arms 52 are driven to move outwardly so as to respectively push the side ground supports 51 to pivotally fold to the unfolded position simultaneously. When the control member 55 is moved upwardly, the reinforcing arms 52 are driven to move inwardly so as to respectively pull the side ground supports 51 to pivotally fold to the folded position at the same time. In other words, by controlling the vertical movement of the control member 55, the side ground supports 51 can be simultaneously folded between the folded position and the unfolded position.

Figure 5:
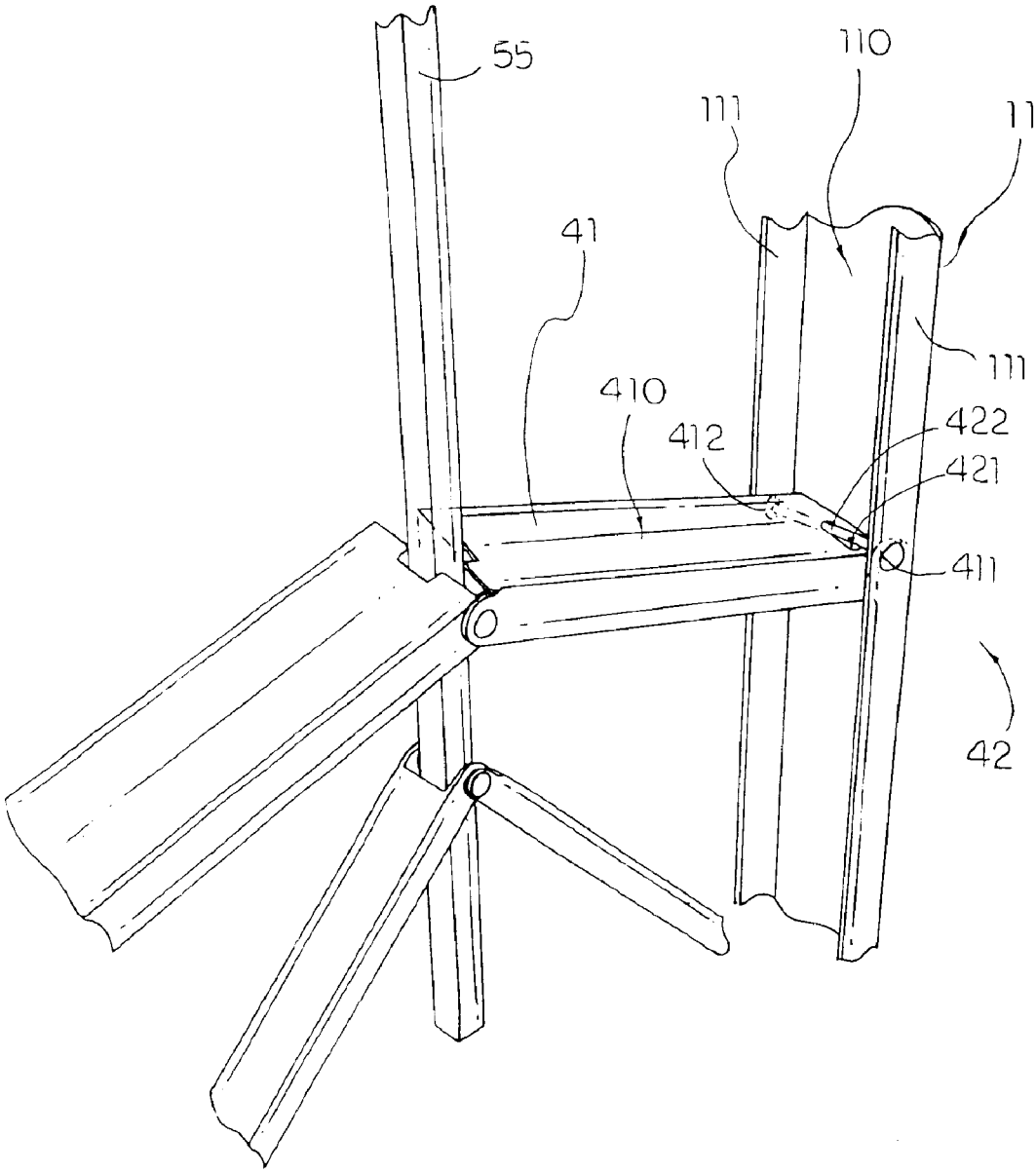
FIG. 5 is a perspective view of the step platform of the ladder according to the above preferred embodiment of the present invention.

As shown in FIG. 5, each of the step platforms 40 comprises two step members 41, each having a step surface 410, pivotally connected at inner ends thereof and two folding joints 42 rotatably connecting two outer ends of the step members 41 to the standing side legs 11 respectively, wherein the inner ends of the step members 41 are capable of upwardly folding up that the step surfaces 410 of the step members 41 are folded to face towards inner surfaces of the standing side legs 11 so as to minimize a distance between the standing side legs 11, and the inner ends of the step members 41 are capable of downwardly unfolding that the step surfaces 410 of the step members 41 are folded in a horizontal position.

According to the preferred embodiment, each of the folding joints 42 has an elongated slot 421 formed at the respective outer end of the step member 41 and a joint axle 422 rotatably mounted at the respective standing side leg 11 wherein the joint axle 422 is slidably extended from an upper side of the step surface 410 to a bottom side of the step surface 410 through the elongated slot 421 in such a manner that the step member 41 is inclinedly mounted at the respective standing side leg 11. Therefore, when the standing frame 10 is folded into the set-up structure, the step surface 401 of each step platform 40 is supported at a horizontal position and when each of the step platforms 40 is folded up, each of step members 41 is rotatably folded to align the step surface 410 facing towards the inner surface of the respective standing side leg 11.

Each of the step members 41 has first and second mounting ribs 411, 412 upwardly and downward extended from two longitudinal edges thereof at the outer end respectively, wherein the joint axle 422 has two ends rotatably mounted to the first and second mounting ribs 411, 412 respectively through the elongated slot 421 so as to inclinedly support the step member 41 with respect to the standing side leg 11.

In addition, each of the standing side legs 11, having a U-shaped cross section, has two sidewalls 111 defining a receiving channel 110 therebetween wherein the inner surface of the standing side leg 11 is formed within the receiving channel 110 in such a manner that when each of the step platforms 40 is folded up, the step member 41 is folded into the receiving channel 10 so as to form a compact structure when the ladder is folded up. Accordingly, the two ends of the joint axle 42 are rotatably mounted at the sidewalls 111 of the respective standing side leg 11 so as to rigidly support the step platform 40 between the standing side legs 11.

Figure 6:
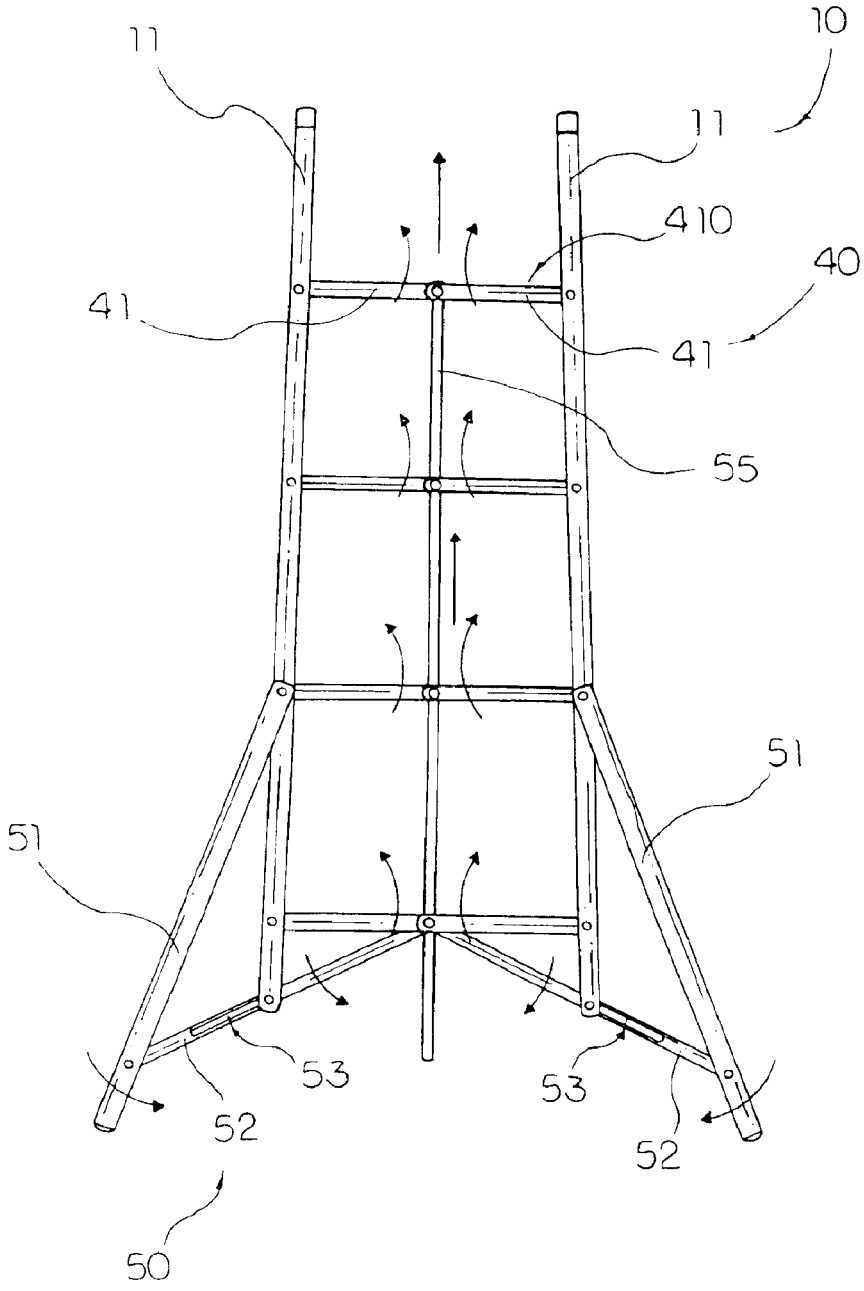
FIG. 6 is a front view of the standing frame of the ladder according to the above preferred embodiment of the present invention.

As shown in FIG. 6, the control member 55 is upwardly extended to pivotally connected each of the step platforms 40 at the inner ends of each two step members 41 in such a manner that when the control member 55 is moved downwardly, the inner ends of the step members 41 are folded downwardly until the step surfaces 410 thereof are folded at the horizontal position while the side ground supports 51 are pushed to pivotally fold to the unfolded position simultaneously.

In other words, when the control member 55 is moved downwardly, the inner ends of the step members 41 are folded upwardly until the steps surfaces 410 thereof are folded to face towards the inner surfaces of the standing side leg 11 while the side ground supports 51 is pulled to pivotally fold to the folded position simultaneously.

Therefore, the control member 55 not only controls the folding operation of the step platforms 40 but also controls the folding operation of the side ground supports 51 at the same time. In addition, the downward force of the user's weight will ensure both the step platforms 40 and the side support enhancement 50 at the unfolded position.

Figure 7:
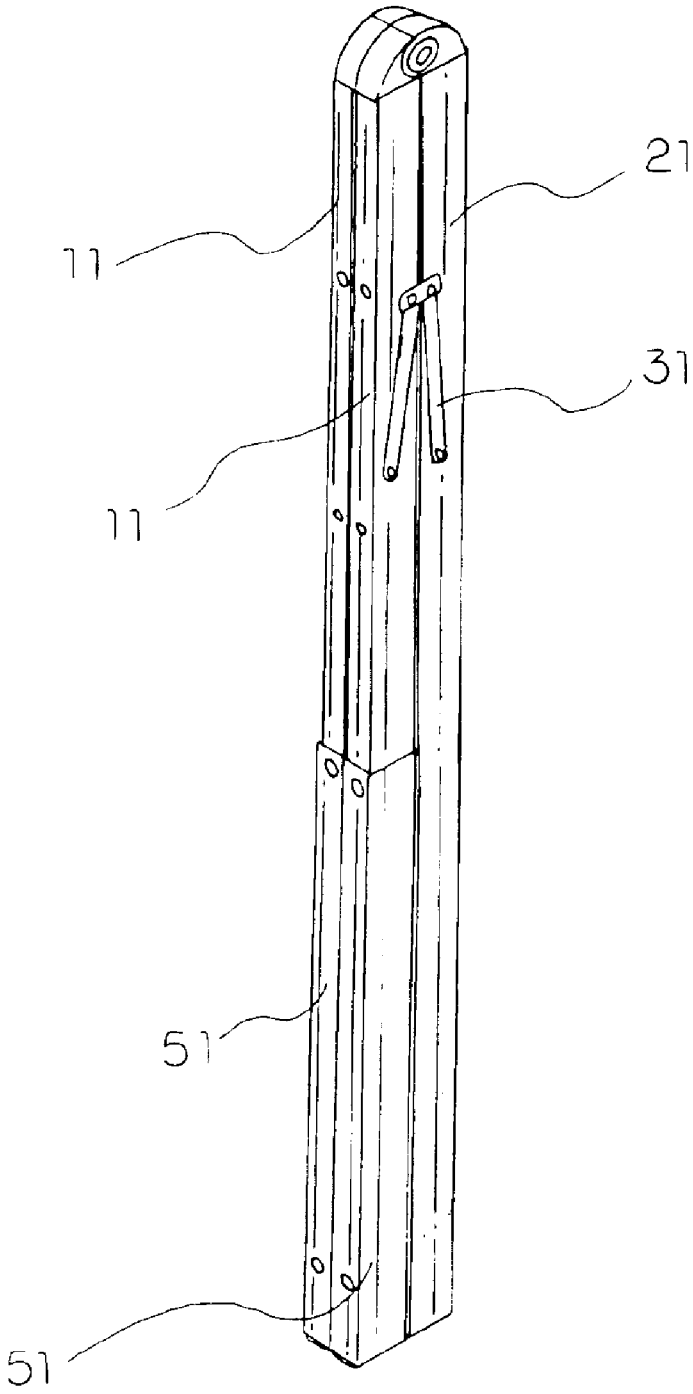
FIG. 7 is a perspective view of the ladder at the folded position according to the above preferred embodiment of the present invention.

In order to fold up the ladder of the present invention into a compact unit for easy carriage and storage, the user is able to pull the control member 55 upwardly to fold up both the step platforms 40 and the side support enhancement 50 such that the standing side legs 11 of the standing frame 10 and the supporting side legs 21 of the supporting frame 20 are respectively folded in an overlapped manner. Then, the user is able to fold the standing frame 10 to the supporting frame 20 to minimize the folding angle A therebetween, so that the ladder is folded into a bundle form, as shown in FIG. 7.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure form such principles. Therefore, this invention is includes all modifications encompassed within the spirit and scope of the following claims.

What is claimed is:

1. A ladder, comprising:

a standing frame comprising two parallel standing side legs;

a plurality of step platforms transversely extended between said standing side legs of said standing frame; and a side support enhancement, comprising:

two side ground supports each having a ground end and a pivot end pivotally connected to said respective standing side leg of said standing frame;

two reinforcing arms pivotally connected to said side ground supports respectively;

means for slidably connecting said reinforcing arms with bottom ends of said standing side legs of said standing frame respectively, wherein said reinforcing arms are arranged to respectively drive said side ground supports between said folded position and said unfolded position, wherein at said folded position, said reinforcing arms are slid inwardly to pivotally pull said side ground supports to align with said standing side legs respectively, and at said unfolded position, said reinforcing arms are slid outwardly to pivotally push said side ground supports away from said standing side legs respectively so that said side ground supports are inclinedly and outwardly extended from said standing side legs respectively to increase a safety distance between said ground ends of said side ground supports; and a control member pivotally connected to upper ends of said reinforcing arms for driving said side ground supports between said folded position and said unfolded position.

2. A ladder, comprising:

a standing frame comprising two parallel standing side legs;

a plurality of step platforms transversely extended between said standing side legs of said standing frame; and a side support enhancement, comprising:

two side ground supports each having a ground end and a pivot end pivotally connected to said respective standing side leg of said standing frame;

two reinforcing arms pivotally connected to said side ground supports respectively;

means for slidably connecting said reinforcing arms with bottom ends of said standing side legs of said standing frame respectively, wherein said reinforcing arms are arranged to respectively drive said side ground supports between said folded position and said unfolded position, wherein at said folded position, said reinforcing arms are slid inwardly to pivotally pull said side ground supports to align with said standing side legs respectively, and at said unfolded position, said reinforcing arms are slid outwardly to pivotally push said side ground supports away from said standing side legs respectively so that said side ground supports are inclinedly and outwardly extended from said standing side legs respectively to increase a safety distance between said ground ends of said side ground supports; and a control member pivotally connected to upper ends of said reinforcing arms for driving said side ground supports between said folded position and said unfolded position;

wherein said pivot end of each of said side ground supports is pivotally connected to said respective standing side leg between said upper and bottom ends thereof, wherein said ground end of each of said side ground supports is downwardly extended below said bottom end of said respective standing side leg in such a manner that when said side ground supports are sidewardly folded apart from said standing side legs respectively, said bottom ends of said standing side legs are rigidly supported on said reinforcing arms respectively.

3. A ladder, comprising:

a standing frame comprising two parallel standing side legs;

a plurality of step plafforms transversely extended between said standing side legs of said standing frame; and a side support enhancement, comprising:

two side ground supports each having a ground end and a pivot end pivotally connected to said respective standing side leg of said standing frame;

two reinforcing arms pivotally connected to said side ground supports respectively;

means for slidably connecting said reinforcing arms with bottom ends of said standing side legs of said standing frame respectively, wherein said reinforcing arms are arranged to respectively drive said side ground supports between said folded position and said unfolded position, wherein at said folded position, said reinforcing arms are slid inwardly to pivotally pull said side ground supports to align with said standing side legs respectively, and at said unfolded position, said reinforcing arms are slid outwardly to pivotally push said side ground supports away from said standing side legs respectively so that said side ground supports are inclinedly and outwardly extended from said standing side legs respectively to increase a safety distance between said ground ends of said side ground supports; and a control member pivotally connected to upper ends of said reinforcing arms for driving said side ground supports between said folded position and said unfolded position;

wherein each of said side ground supports has a U-shaped cross section defining a receiving cavity for receiving a lower portion of said respective standing side leg therein when said side ground supports are folded towards said standing side legs respectively at said folded position;

wherein said pivot end of each of said side ground supports is pivotally connected to said respective standing side leg between said upper and bottom ends thereof, wherein said ground end of each of said side ground supports is downwardly extended below said bottom end of said respective standing side leg in such a manner that when said side ground supports are sidewardly folded apart from said standing side legs respectively, said bottom ends of said standing side legs are rigidly supported on said reinforcing arms respectively.

4. The ladder, as recited in claim 3, wherein said connecting means comprises two sliding joints each of which has an elongated sliding slot formed along said respective reinforcing arm and comprises a slider axle which is provided at said bottom end of said respective standing side leg and slidably passed through said corresponding sliding slot such that said reinforcing arms are slidably connected to said bottom ends of said standing side legs of said standing frame respectively.

5. The ladder, as recited in claim 4, wherein each of said sliding slots, having a predetermined length, has a folding end and an opposed blocking end, wherein when said slider axle is slid to said folding end of said sliding slot, said side ground support is pulled to folded towards said respective standing side leg, and when said slider axle is slid to said blocking end of said sliding slot, said side ground support is pushed to fold outwardly from said respective standing side leg.

6. The ladder, as recited in claim 4, wherein each of said step platforms comprises two step members, each having a step surface, pivotally connected at inner ends thereof and two folding joints rotatably connecting two outer ends of said step members to said standing side legs respectively, wherein said inner ends of said step members are capable of upwardly folding up that said step surfaces of said step members are folded to face towards inner surfaces of said standing side legs so as to minimize a distance between said standing side legs, and said inner ends of said step members are capable of downwardly unfolding that said step surfaces of said step members are folded in a horizontal position.

* * * * *